United States Patent [19]

Rimington

[11] Patent Number: 5,052,894

[45] Date of Patent: Oct. 1, 1991

[54] PORTABLE COMPRESSED AIR SUPPLY WITH REMOTE CONTROL

[75] Inventor: Richard M. Rimington, Powys, Wales

[73] Assignee: Mangar Aids Limited, Powys, Wales

[21] Appl. No.: 362,496

[22] Filed: Jun. 7, 1989

Related U.S. Application Data

[63] Continuation-in-part of Ser. No. 250,389, Sep. 28, 1988, abandoned.

[51] Int. Cl.[5] ..... F04B 49/02

[52] U.S. Cl. ..... 417/44; 417/234

[58] Field of Search ..... 417/38, 53, 234, 44; 297/DIG. 3, DIG. 8, DIG. 10; D24/1.1, 3; D12/128, 133

[56] References Cited

U.S. PATENT DOCUMENTS

| | | | |
|---|---|---|---|
| 2,719,986 | 10/1955 | Rand | 297/DIG. 3 |
| 3,479,087 | 11/1969 | Burke | 297/DIG. 10 |
| 4,188,677 | 2/1980 | Zur | 5/68 |
| 4,614,479 | 9/1986 | Liu | 417/33 |
| 4,621,984 | 11/1986 | Fussell | 417/234 |
| 4,651,838 | 3/1987 | Hamilton et al. | 417/38 |

*Primary Examiner*—Leonard E. Smith
*Assistant Examiner*—David W. Scheuermann
*Attorney, Agent, or Firm*—Neil F. Markva

[57] ABSTRACT

A motor driven compressor is supplied with power from a battery and supplies compressed air at the outlet of an air hose. Compressed air via the hose is supplied to a lifting device, for example a bellows of an invalid seat assembly. In the apparatus the output of the compressor is passed through a non-return valve so that when the compressor is turned off supplied air cannot bleed back through the compressor. A pressure switch breaks the electrical circuit should pressure build up excessively at the output. Additionally, an air dump valve is provided to enable pressure in the output line to be vented to atmosphere. Operation of the compressor is controlled by a hand control.

8 Claims, 6 Drawing Sheets

PORTABLE COMPRESSED AIR SUPPLY WITH REMOTE CONTROL

RELATED APPLICATIONS

This is a continuation-in-part of application Ser. No. 250,389, filed Sept. 28, 1988, now abandoned.

This invention relates to improvements in or relating to compressed air supply apparatus more particularly but not exclusively used to supply compressed air to invalid seat assemblies which enable handicapped persons to be raised and lowered.

Such seat assemblies are often provided with a bellows which is inflatable by means of a compressor driven by the mains supply and which supplies compressed air to the bellows to thereby inflate the bellows and raise the seat. It is believed that such an arrangement sometimes tends to involve inherent disadvantages. Firstly, it is not always desirable or convenient for the compressor to be connected to a mains supply. Such compressors are restricted to use where a mains supply is available. Where a mains powered compressor is provided to raise and lower a seat in a bath, for safety reasons, the compressor is provided outside the bathroom. This tends to be disadvantageous in itself and it also tends to be disadvantageous that a long trailing airline supply is required from the compressor to the seat assembly in the bath. Secondly, the compressor is a 240 v. compressor which is necessarily switched on continuously during use, even after the bellows has been inflated to raise the seat to the required height, and this, of course, tends to be rather noisy and perhaps a source of some irritation. Such compressors may also have further disadvantages related to lack of portability, and ease of use.

It is an object of the present invention to at least alleviate one or more of the aforementioned disadvantages.

According to the present invention there is provided battery powered compressed air supply apparatus comprising means to supply compressed air to an air-inflatable device, for example, a lifting device or a bellows of an invalid seat assembly, said apparatus being provided with a non-return valve so that pressure is not lost from the device back through the apparatus when the apparatus is switched off after use, said apparatus also being provided with a dump valve so that air may be exited from the device when required.

Further according to the present invention there is provided an invalid seat assembly comprising a lifting device in the form of a bellows, a battery and compressed air supply apparatus in accordance with the immediately preceding paragraph.

Still further according to the present invention there is provided a method of raising and lowering a lifting device by means of compressed air, for example a bellows of an invalid seat assembly, said method comprising:

a) activating a battery powered compressor to supply compressed air to the lifting device until the required height for the lifting device is reached;

b) de-activating the compressor whilst the lifting device is at the required height with said lifting device remaining at said required height;

c) activating a dump valve to allow the air to exit from the lifting device and lower the lifting device.

More generally, still further according to the present invention there is provided a method of inflating and deflating an air-inflatable apparatus by means of compressed air, for example a bellows of an invalid seat assembly said method comprising:

a) activating a battery powered compressor to supply compressed air to the apparatus until the required inflation level is reached;

b) de-activating the compressor whilst the apparatus is at the required inflation level with said apparatus remaining at said required inflation level;

c) activating a dump valve to allow the air to exit from the apparatus and deflate the apparatus.

Said methods may comprise deactivating the dump valve to maintain the lifting device at a lower height (or maintain the apparatus at a lower level of inflation).

By the present invention, compressed air supply apparatus may be provided which is advantageously driven from a battery (e.g. 12 or 24 V d.c.) rather than from a mains supply. Since the compressor of the apparatus is not required to be running all the time the device is in use, there is less drain on the battery power source and the battery may be much smaller than would otherwise be the case. In fact, it is doubtful that a viable, practical arrangement would be possible where the compressor is being run continuously from a battery because even a bulky battery would drain fairly quickly. Since the compressor need only be operated intermittently there may thus be less irritation from the noise of the compressor running; the compressor may be switched off once the apparatus is inflated the required amount e.g. if the apparatus is a lifting device, when it is in the required height position.

In fact, the feature of switching the compressor on only when needed leads to a dramatic reduction in battery size commensurate with a given useful service. It conserves energy unlike a battery powered compressor that is left on, having its output controlled by air valves. It is unlikely that such a compressor could be usefully portable due to the battery capacity required as a result of the continuous running.

The use of low voltages allows safe use of the compressor in environments where mains powered equipment requires additional precautions to be made (e.g. in bathroom or out of doors).

Preferably, the compressor has a pressure switch set to be activated at a particular safety pressure, for example, 5 p.s.i. or 80 p.s.i., so that if the compressor is still switched on at such safety pressure, said pressure switch will be activated to switch off the compressor. The pressure switch will usually be located in an air line in between the non-return valve and the output, possibly before the dump valve.

Also, preferably, operation of the compressor is controlled by a hand control remote from the compressor. The compressor may be switched on and off by an air switch (usually a microswitch) controlled by way of said hand control or by an electric control or any suitable device. Advantageously, provision of a remote hand control allows delicate switches to be provided housed with the compressor and for the control itself to be of a sturdy, robust nature. Preferably, the hand control is a dual control in that it may be operated not only to switch the compressor on and off but also to open and close the dump valve.

In one embodiment of the present invention, an air line is provided from the compressor to an output for the lifting device, and the non-return valve is connected in between a, or said, pressure switch and the compressor, the dump valve being located downstream of the pressure switch.

Other advantageous features, for example of the air supply apparatus or of an electrical circuit of the compressor, will be apparent from the following description and drawings.

Embodiments of compressed air supply apparatus and of an invalid seat assembly incorporating the apparatus, in accordance with the present invention and method of raising and lowering air-inflatable apparatus in the form of a lifting device in accordance with the present invention, will now be described, by way of example only, with reference to the accompanying schematic drawings, in which.

Figure 8A:
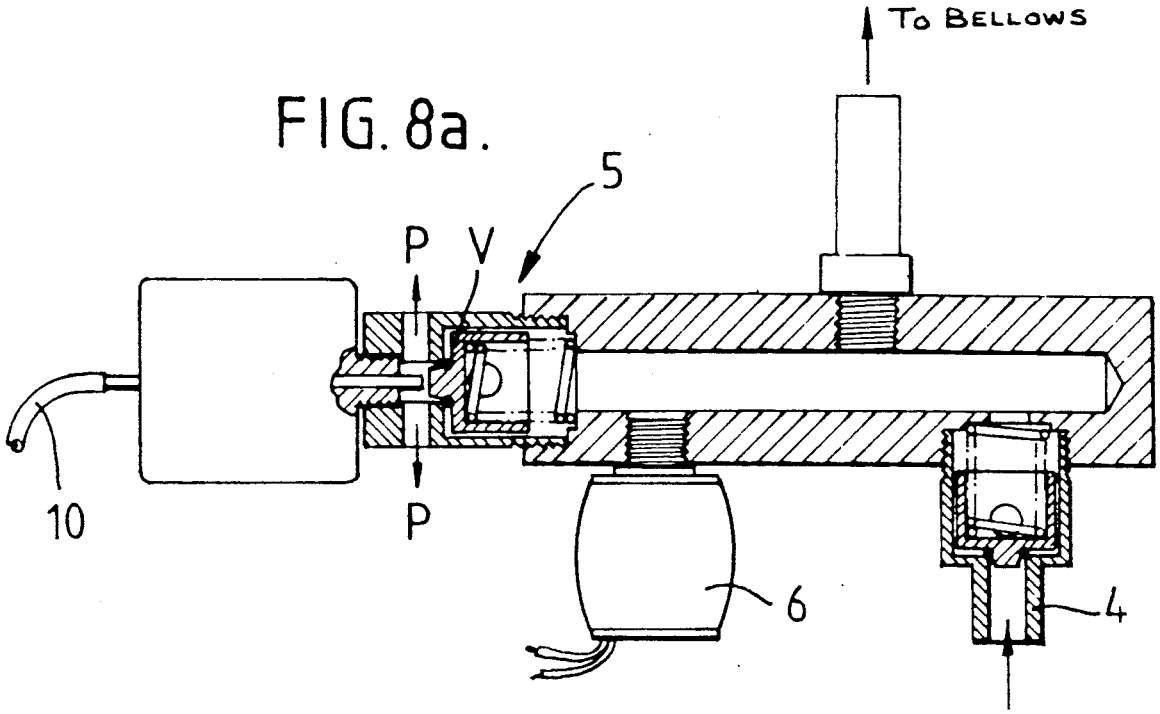
Figure 8B:
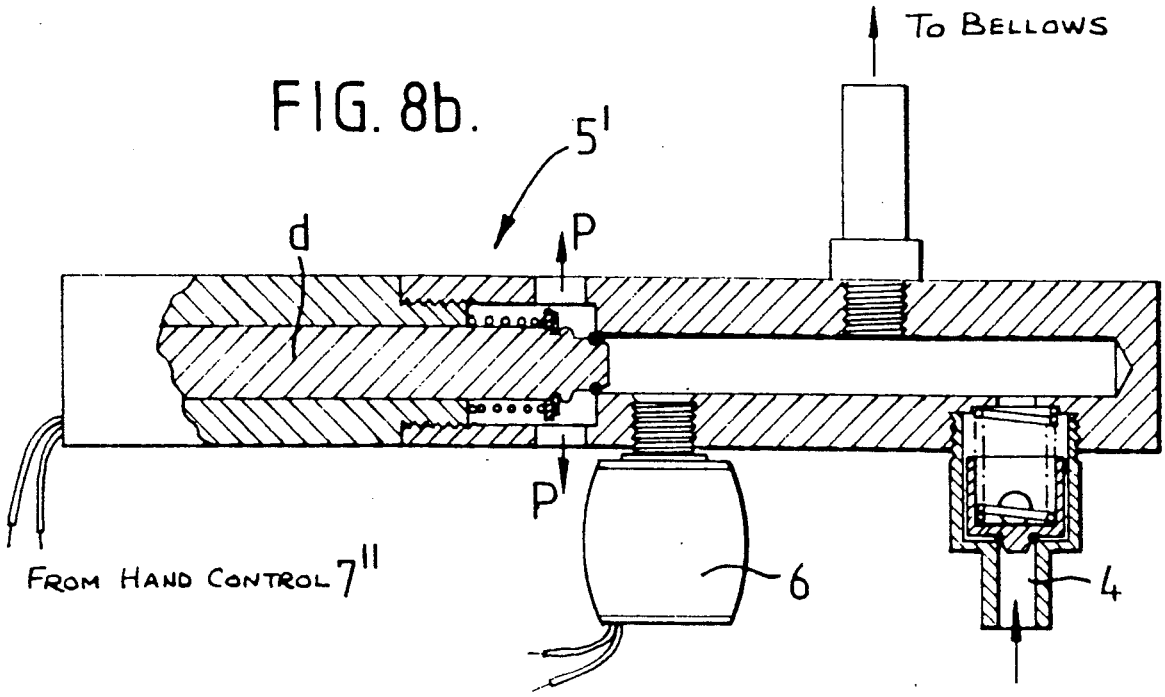
Figure 9:
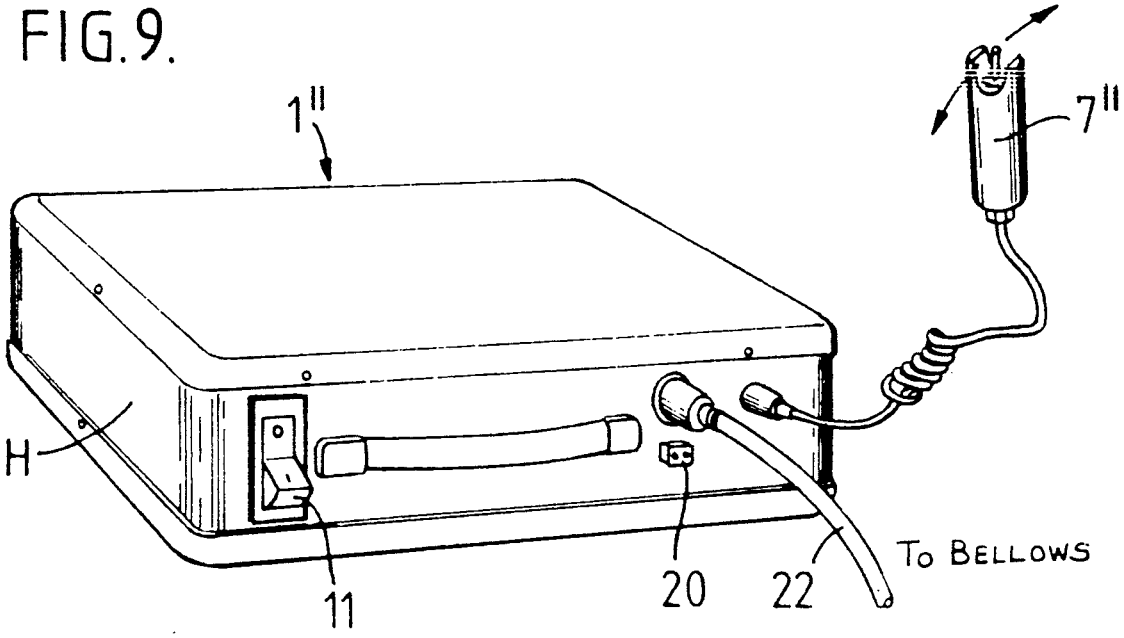
Figure 10:
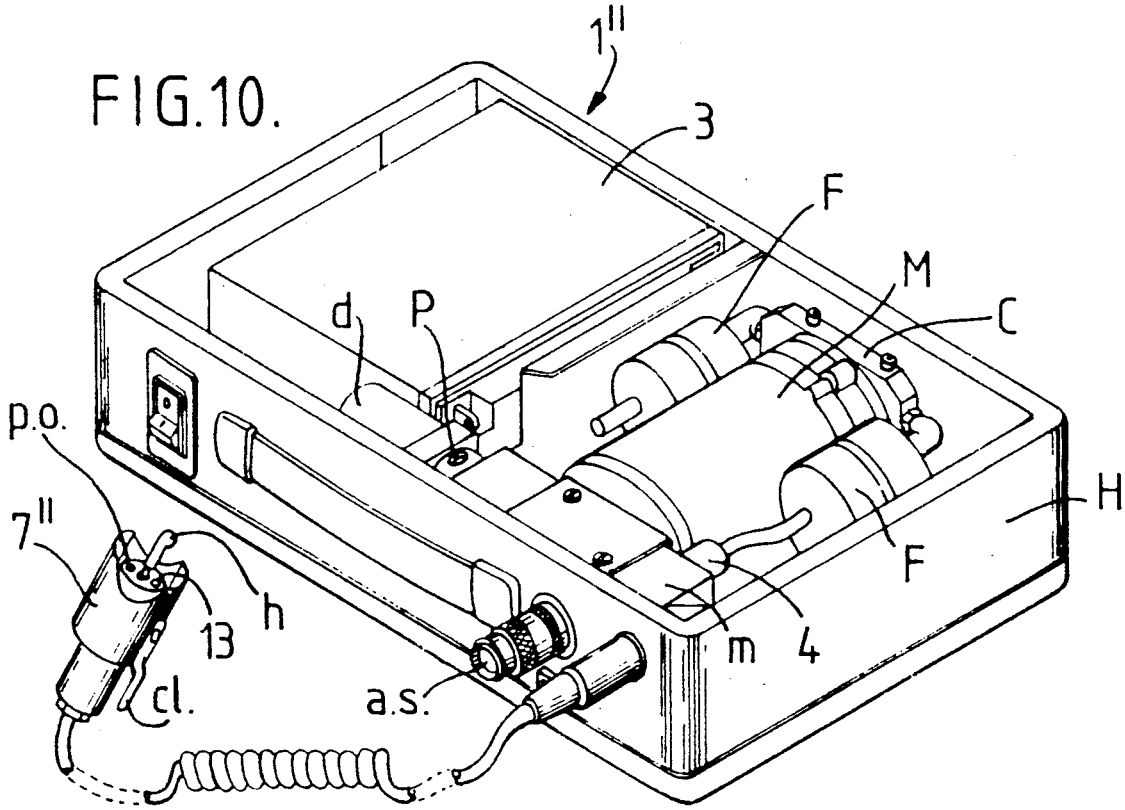

FIGS. 8*a*, 8*b* show an alternative version of a dump valve of the apparatus; and FIGS. 9 and 10 show closed and open views of a further modified embodiment of the apparatus.

Figure 1:
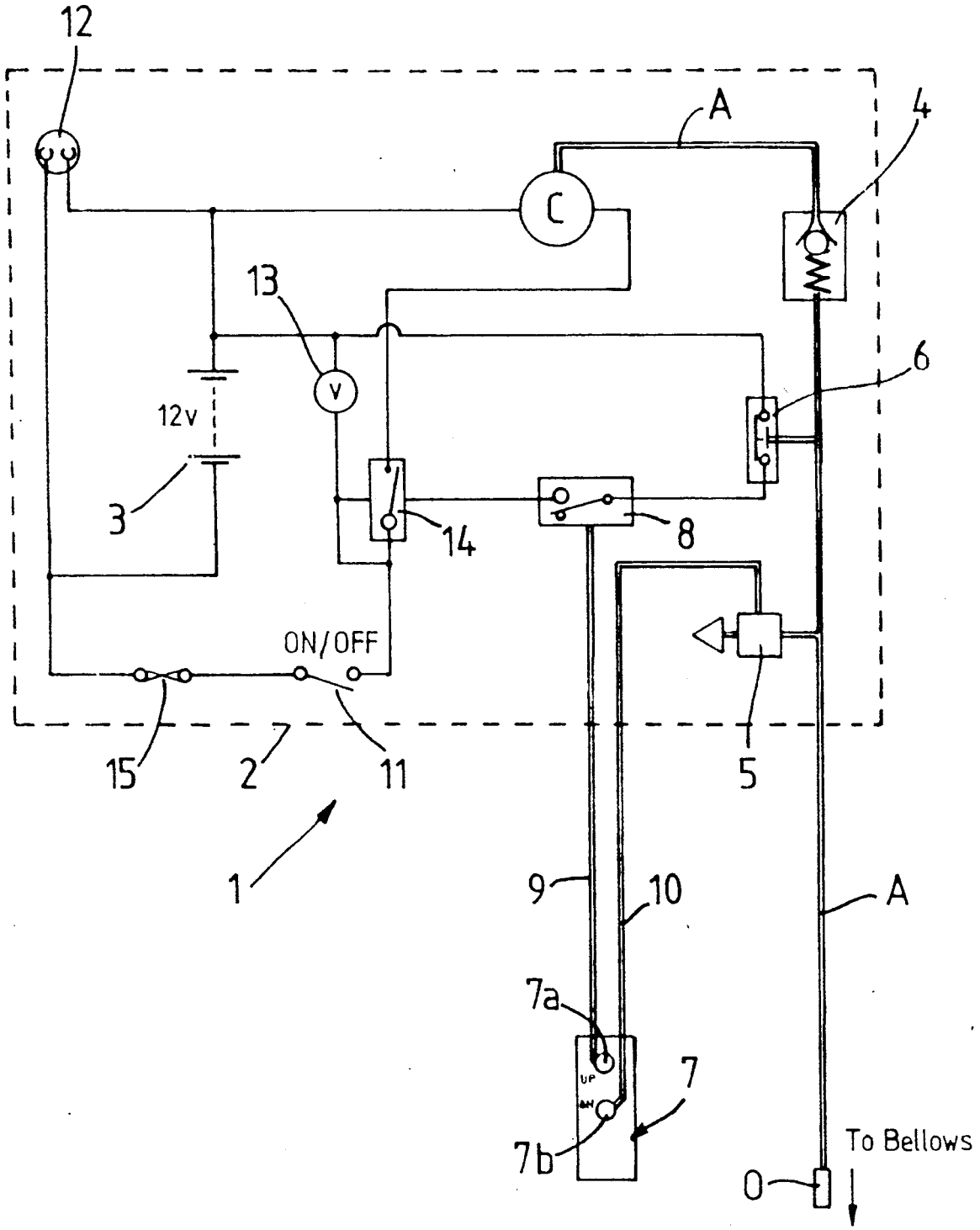
FIG. 1 shows a first embodiment of the apparatus.

FIG. 1 shows compressed air supply apparatus 1 having a housing 2 (represented by a dashed line in the figure). In practice, a battery 3 may be located separately underneath the housing 2 (see FIG. 7, for example) and be connected to the compressor C by way of a battery lead socket (not shown in FIG. 1) on the housing 2. In this way the battery may be easily disconnected from the compressor for charging or transportation. Additionally, provision of an easily disconnectable battery allows use of the compressor where a battery (usually 12 V.d.c.) is already going to be available in the immediate vicinity of the apparatus in use, for example, in a car or a powered wheelchair. The apparatus can then be utilized with that battery rather than with its own special battery power source 3.

In general, rechargeable batteries are heavy and battery weight is approximately proportional to capacity, so that the battery is (in general) designed to have seemingly the least capacity commensurate with supplying compressed air for a useful length of time. Weight is, of course, an important factor affecting the portability of the compressor (or assembly including the battery) and therefore a battery of as low weight as seems reasonable is selected.

The apparatus 1 as shown in the FIG. 1 is driven by the battery 3 and is for supplying compressed air via output O from an air line A, to a lifting device, in this instance a bellows of an invalid seat assembly (not shown).

Most importantly, the apparatus has a compressor C in the housing 2 which is connected to a non-return valve 4 in air line A so that once the compressor is switched off, after use, pressure is not lost from the lifting device back through the compressor (as would be in the case of prior art, continuously driven mains compressors). The apparatus 1 is provided with an air 'dump' valve 5 (see FIG. 8*a*) in air line A so that air may be exhausted from the bellows when it is required to lower the invalid seat. Since the apparatus 1 does not automatically provide for deflation of the bellows when the compressor is switched off (non-return valve 4 stops air leaking from the apparatus), a pressure switch 6 is provided (in air line A in between the non-return valve 4 and dump valve 5) which breaks the electrical circuit at a pressure, in this instance, of 5 p.s.i. The pressure switch 6 therefore acts as an important safety measure preventing the bellows from becoming accidentally over-pressurized.

Operation of the apparatus 1 is, advantageously, controlled by means of a hand control 7 arranged remote from compressor C and the housing 2. The hand control is connected to an air switch 8 by a first air line 9 and to the dump valve 5 by a second air line 10. Therefore, the hand control basically provides a dual function namely: activation of the air switch 8 to switch the apparatus 1 on and off via actuation of press button 7*a* and opening and closing of the dump valve 5 to control deflation of the bellows via actuation of press button 7*b*. The provision of the dual function air hand control is believed to be convenient but if preferred one or both functions of the hand control may be performed electrically (see FIGS. 8*b*, 9 and 10 discussed later) or by any suitable means.

The electrical circuit of the apparatus 1 should be evident from FIG. 1 of the drawings. An external on/-off switch 11 is provided mounted on a front panel (not shown in FIG. 1) of the housing 2, a charge/external power socket 12 is provided along with a battery condition indicator 13 (advantageous for monitoring the charge level of the battery) and a relay 14 is provided in series between the compressor C and the on/off switch 11. Once the switch 11 is closed, closing of switch 8 by the use of hand control 7 (i.e. pressing button 7*a*) causes relay 14 to be closed and compressor C is activated to supply compressed air via line A, through non-return valve 4, past pressure switch 6 and past the dump valve, through output O to inflate the bellows of the invalid seat. If the pressure reaches 5 p.s.i. the pressure switch is activated to cut off power to the compressor C and the bellows remains inflated. When it is desired to deflate the bellows, button 7*b* is depressed and the dump valve is activated to allow air to escape from the system through the valve in a manner which should be evident more particularly referring to FIG. 8*a*. Air is vented to the atmosphere via ports P. On release of button 7*a* the air switch is opened and on release of button 7*b* the dump valve is closed. A 20 amp fuse 15 is provided in the electrical circuit. Also, air filters F will, in practice, be provided (see FIGS. 9 and 10 which represents a modified embodiment and which is discussed later) in a manifold m from the compressor C and these will act as silencers.

The dump valve 5 is shown in more detail in FIG. 8*a* which is a cross-sectional view. As should be evident on depressing button 7*a* air is forced along air line 10 which moves valve member V of the dump valve to the right in FIG. 8*a* against spring biassing means to allow air to be vented from the system via ports P.

FIG. 8*b* shows a modified, electrically-operated (rather than air-operated) dump valve 5'. The operation of the valve should be self-evident and is merely an electrically operated equivalent to dump valve 5, and utilised with an electric switch hand control 7'' (see FIGS. 9 and 10).

FIGS. 9 and 10 show a further modified embodiment 1'' of the compressed air supply apparatus 1''. The apparatus 1'' is of the general form previously described except that the battery is located in a housing H at the side of, rather than underneath, the compressor M. C. As should be evident from FIGS. 9 and 10, this embodiment represents a very convenient portable unit and is of similar appearance to an attache case. FIG. 10 is more detailed than FIG. 9 since the upper lid has been removed to expose the various components inside. The dump valve is operated electrically (see FIG. 8*b*) rather than by air, via hand control 7", the operation of which should be self-evident. h is the hand control, three position toggle switch, p.o. is a green L.E.D. power on light, 13 is a red low battery voltage indicator, m is a manifold, a.s. is the air socket which connects to line 22 (see FIG. 9) C. l. is clip on hand control 7".

Figure 2:
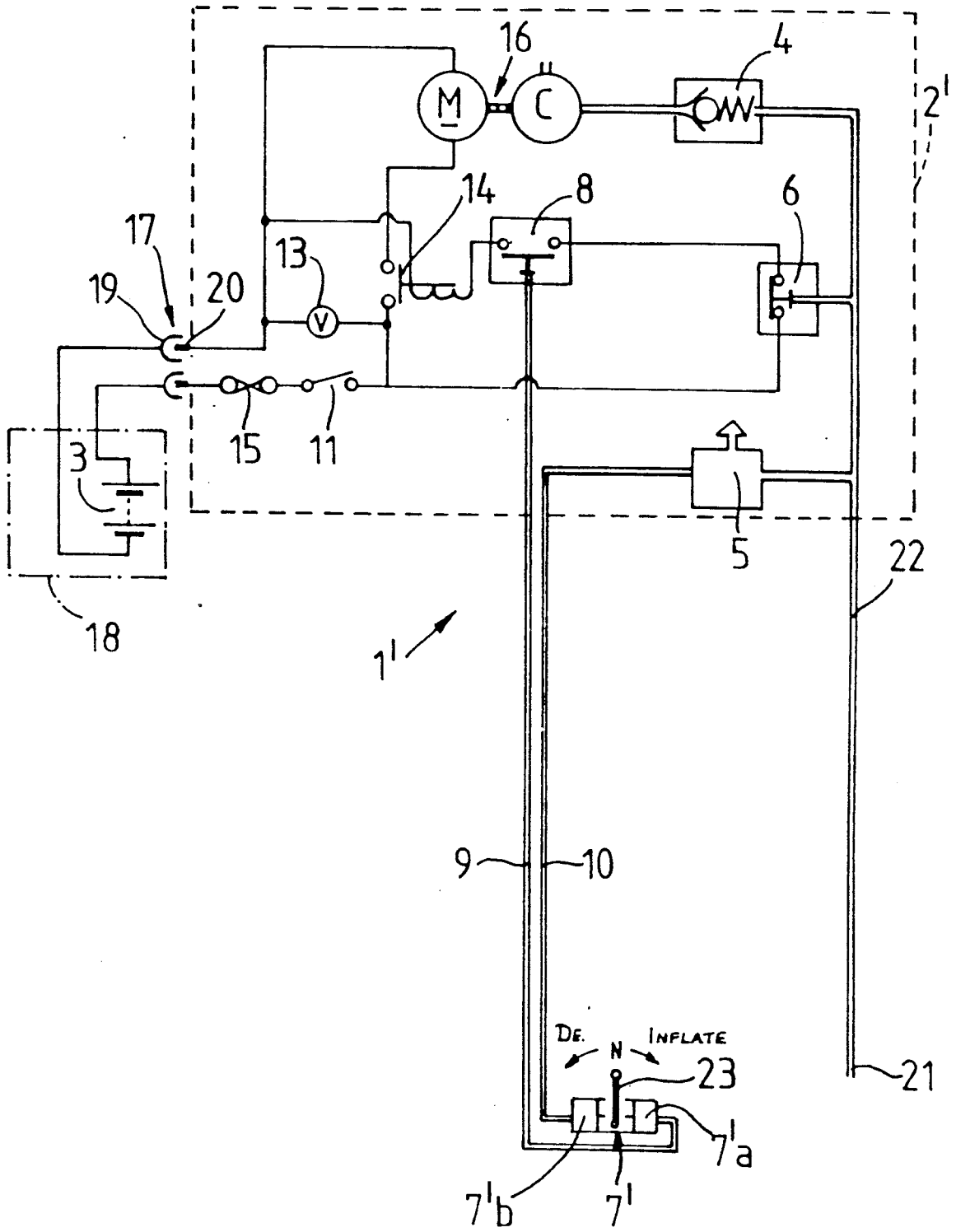
FIG. 2 shows a modified embodiment of the apparatus.
Figure 3:
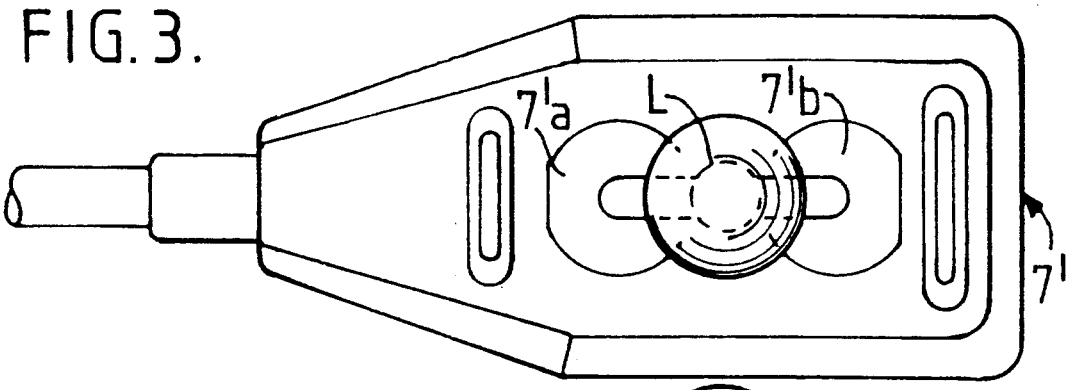
FIGS. 3 to 6 show in more detail a modified hand control of the apparatus shown in FIG. 2.
Figure 4:
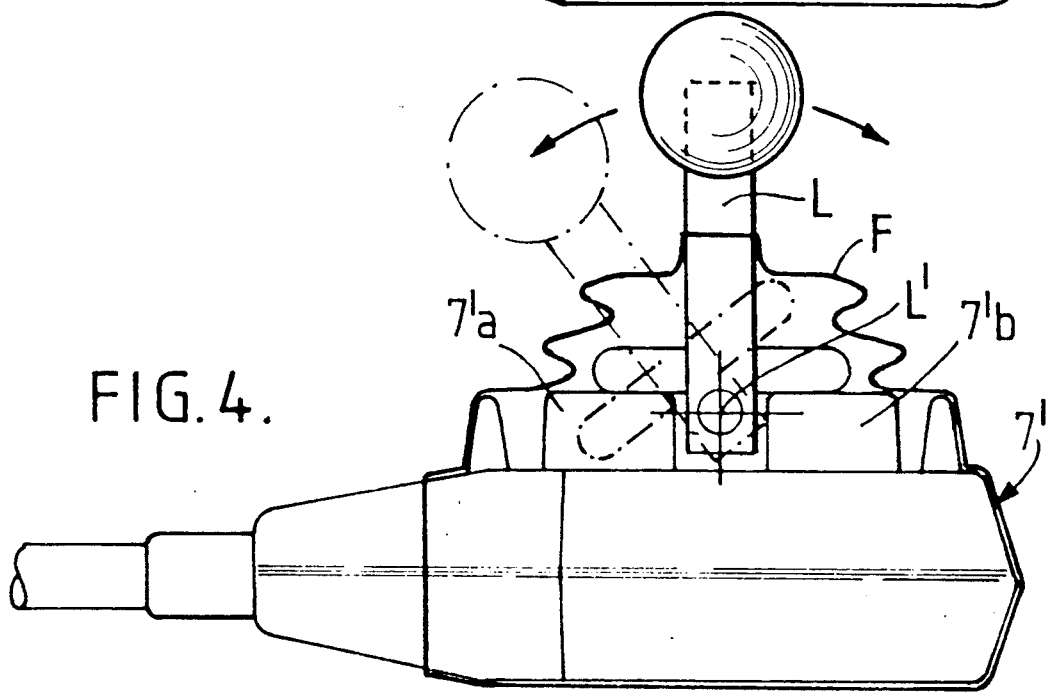
Figure 5:
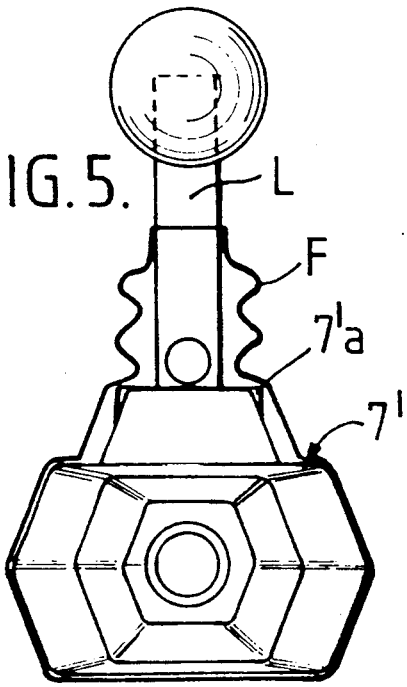
Figure 6:
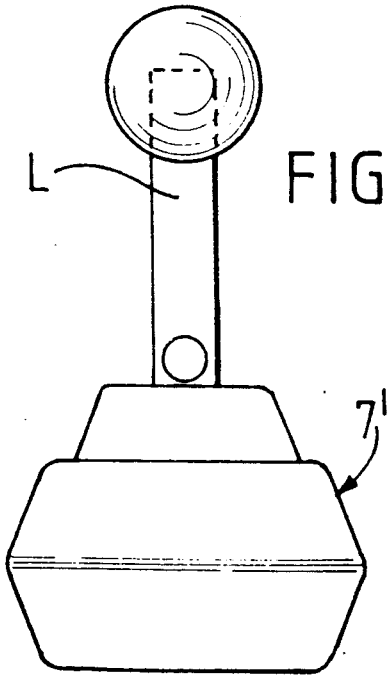

FIG. 2 shows a modified embodiment of the compressed air supply apparatus which has a few modifications over and above that shown in FIG. 1. A compressed air supply apparatus 1' (see FIG. 7 also) has a housing 2' (represented by a dashed line in FIG. 2). The battery 3 also has a housing 18 (represented by the chain dotted line in FIG. 2). In practice, the battery housing 18 is detachably slung beneath the compressor housing 2', (see FIG. 7) the two being electrically connected by the plug and socket connection 17. In this way the battery may be charged by connecting a charger to the socket 19 of connection 17. Additionally, the apparatus 1' may be used without the battery if an alternative power source (e.g. vehicle battery) is available.

Figure 7:
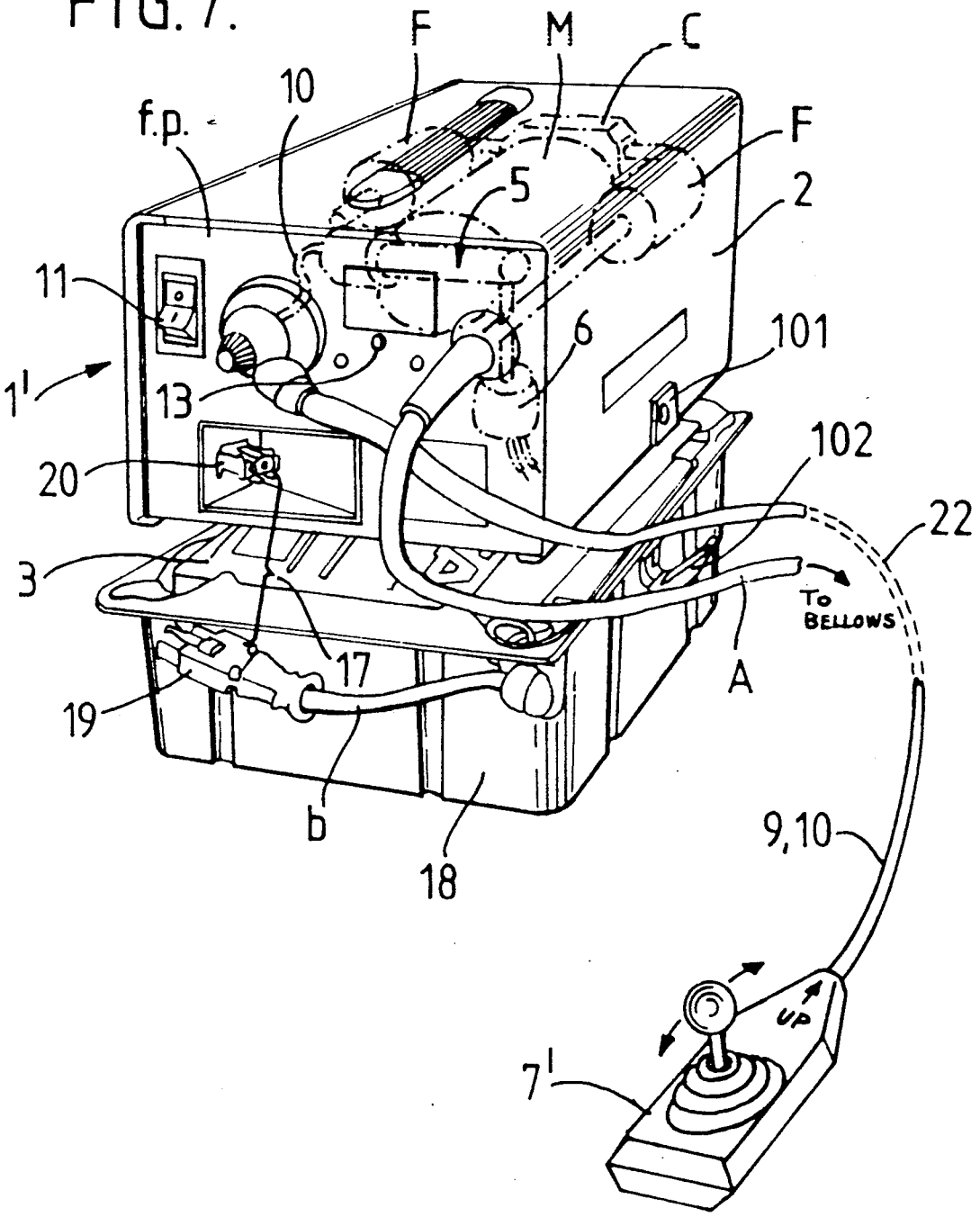
FIG. 7 shows an external perspective view of the hardware of the embodiment shown in FIG. 2.

As should be evident from FIG. 7, housing 2' is provided with projection means 101 (only one shown) to connect housing 18 thereto by clips 102 (only one shown). Two projection means 101 are provided on opposite sides of housing 2" and two clips 102 are provided on opposite sides of housing 18.

In general, rechargeable batteries are heavy, their weight being approximately proportional to their capacity. It is therefore important that the equipment is designed to require least capacity commensurate with supplying compressed air for a useful length of time so that the equipment remains easily portable.

In the embodiment shown in FIG. 2 the motor driven compressor 16 denoted as symbol M for the motor and C for the compressor proper (rather than just C as in FIG. 1) is supplied with power from the battery 3 and supplies compressed air at the outlet 21 of the air hose 22.

Most importantly the output of the compressor is passed through a non-return valve 4 so that when the compressor is turned off supplied air cannot bleed back through the compressor. Should pressure build excessively in the output, a pressure switch 6 (set to activate at a predetermined value) will break the electrical circuit thereby switching off the compressor and negating any need to bleed excess pressure from the system. The apparatus 1' is provided with an air dump valve 5 (see FIG. 8*a*) to enable pressure in the output line 22 to be vented to atmosphere. Operation of the compressor 16 is advantageously controlled by means of a modified hand control 7' arranged remote from the compressor 16. The hand control is joined to switch 8 and dump valve 5 (within housing 2) by flexible air lines 9 and 10. Movement of lever 23 of control 7' from its neutral or static position in one direction will pressurise line 9 thereby activating switch 8 and turning compressor 16 on. Return of lever 23 to its neutral position switches the compressor off again. Movement of the lever in the opposite direction will pressurise line 10 and activate the dump valve 5. Provision of the dual function air hand control allows the delicate mechanisms of switch 8 and valve 5 to jbe housed within the housing 2 and the hand control to be built in a robust fashion but one or both functions of the hand control may be performed electrically or by any suitable means (see FIGS. 8*b*, 9 and 10).

The electrical circuit of the apparatus 1' should be evident from the schematic drawing. An external On/-Off switch 11 is provided mounted on a front panel f.p. of housing 2' (see FIG. 7), an input power socket 20 is provided along with a battery condition indicator 13 and a relay 14 is provided in series between the compressor 16 and the On/Off switch. Clearly, once switch 11 is closed, relay 14 may be activated by closing switch 8 using the hand control 7'. When relay 14 is closed the compressor 16 runs supplying air through non return valve 4, past pressure switch 6 and dump valve 5, to the outlet 21 of air hose 22. If pressure builds sufficiently to open switch 6 the energising circuit of relay 14 is broken, thus opening the relay and switching off the compressor. When it is desired to depressurise the system the dump valve is activated by hand control 7 allowing the system to vent to atmosphere. Use of the hand control allows incremental pressurisation or depressurisation. A fuse link 15 is provided to the electrical circuit.

The modified hand control is shown in FIGS. 3 to 7. The general form of the hand control is known save for its lever actuation. As should be obvious from thr drawings the lever is pivotally mounted and may be moved about axis L' in order to depress button 7'*a* or 7'*b*. Flexible cover F is provided as shown.

The invention provides means to control (starting and stopping) a battery powered portable air compressor for supplying air to an inflatable apparatus. The remote but attached hand means as well as controlling the operation of the compressor also controls a dump valve for regulating the deflation of said apparatus.

Therefore, further according to the present invention there is provided a hand control to remotely control the pressurisation and/or depressurisation of the apparatus using the compressor. Said control has a neutral or static position, a position to activate pressurisation and a position to activate depressurisation. Protection against overpressurisation may be provided by a pressure switch which will break the circuit to the compressor should said pressure switch be activated.

Said controls eliminate the need to spill excess air thereby utilising battery capacity to its maximum efficiency (no unnecessary running) thereby enabling a given service to be provided by the smallest battery commensurate with that service. Thus the portability of the compressor is enhanced.

It is to be understood that the scope of the present invention is not to be unduly limited by the particular choice of terminology and that a specific term may be replaced by any equivalent or generic term where sensible. Further it is to be understood that individual features, method or functions related to the compressor and/or electric circuit and/or air controls thereof or combinations thereof might be individually patentably inventive. Additionally, the present invention may encompass a lifting device or inflatable apparatus including one or more compressors. The present invention may encompass a compressor for supplying compressed air to a device other than a lifting device.

The compressed air supply apparatus as described and illustrated in the drawings may be used to supply compressed air to an invalid seat assembly of a known type, having an inflatable bellows to raise a seat of the assembly. In particular the apparatus may be used with the seat assembly shown in U.S. patent application Ser.

No. 196,309, the content of which is hereby incorporated into this specification by reference.

Possibly the most important aspect of the present invention is the convenient portability with its own power source, as well as the convenience of a hand control remote from the compressor.

The present invention also provides battery powered compressed air supply apparatus comprising a compressor and means to supply compressed air to an air-inflatable device, for example, a lifting device or a bellows of an invalid seat assembly, said apparatus being provided with a non-return valve so that pressure is not lost from the device back through the apparatus when the apparatus is switched off after use, said apparatus also being provided with a dump valve so that air may be exited from the device when required, said apparatus having a pressure switch set to be activated at a particular safety pressure, for example, 5 p.s.i., so that if the compressor is still switched on at such safety pressure, said pressure switch will be activated to switch off the compressor.

What we claim is:

1. Portable battery-powered compressed-air supply apparatus comprising:

a) a compressor and means to supply compressed air to a bellows of an invalid seat assembly, b) said compressor being mounted in a housing having a control panel, c) means for holding a battery adjacent to the compressor to allow, in use, the compressor and battery to be transported as a portable unit, d) a non-return valve for avoiding pressure loss from the bellows back through the apparatus when the apparatus is switched off at the control panel after use, e) a dump valve for exiting air from the apparatus when required, and in which operation of the compressor is controlled by a hand-held control remote from the compressor and from the housing control panel, f) said hand-held control being a dual control in that it can be operated not only to switch the compressor on and off but also to open and close the dump valve.

2. Apparatus as claimed in claim 1 having a pressure switch set to be activated at a particular safety pressure, for example, 5 p.s.i. or 80 p.s.i., so that if the compressor is still switched on at such safety pressure, said pressure switch will be activated to switch off the compressor.

3. Apparatus as claimed in claim 2 wherein the pressure switch is located in an air line between the non-return valve and the output.

4. Apparatus as claimed in claim 1 wherein the compressor is switched on and off by an air switch controlled by said hand control.

5. Apparatus as claimed in claim 1 wherein the hand-held control includes switch means having a neutral or stactic position, a position to activate pressurization and a position to activate depressurization.

6. Apparatus as claimed in claim 1 wherein an air line is provided from the compressor to an output for the bellows, and the non-return valve is connected between a pressure switch and the compressor, the dump valve being located downstream of the pressure switch.

7. Apparatus as claimed in claim 3 wherein the pressure switch is located before the dump valve.

8. Apparatus as claimed in claim 5 wherein said switch means includes a level member movable to any one of said three positions.

* * * * *